United States Patent [19]

Ace

[11] Patent Number: 4,807,551

[45] Date of Patent: Feb. 28, 1989

[54] PORTABLE OUTRIGGER

[76] Inventor: Gwyn C. Ace, P.O. Box 223, Trout Creek, Ontario, Canada, P0H 2L0

[21] Appl. No.: 120,684

[22] Filed: Nov. 9, 1987

Related U.S. Application Data

[63] Continuation of Ser. No. 840,926, Mar. 18, 1986, abandoned.

[51] Int. Cl.[4] ..... B63B 43/14

[52] U.S. Cl. ..... 114/123; 114/347

[58] Field of Search ..... 114/61, 123, 125, 283, 114/284, 292, 347

[56] References Cited

U.S. PATENT DOCUMENTS

| | | | |
|---|---|---|---|
| 225,800 | 3/1880 | Corvaja | 114/123 |
| 232,435 | 9/1880 | Barnes | 114/125 |
| 545,095 | 8/1895 | Redmond | 114/125 |
| 1,132,924 | 3/1915 | Gepack | 114/123 |
| 1,152,654 | 9/1915 | Nosworthy et al. | 114/125 |
| 1,369,670 | 2/1921 | Kauffman | 114/123 |
| 1,663,888 | 3/1928 | Osten | 114/123 |
| 1,710,625 | 4/1929 | Kapigian | 114/123 |
| 2,370,069 | 2/1945 | Patten | 114/345 |
| 3,002,484 | 10/1961 | Dube | 114/61 |
| 3,276,413 | 10/1966 | Dolph et al. | 114/123 |
| 3,537,417 | 11/1970 | Beckner | 114/123 |
| 3,593,684 | 7/1971 | Cogliano | 114/61 |
| 3,696,772 | 10/1972 | Sundelin | 114/39 |
| 3,763,813 | 10/1973 | Holtz | 114/123 |
| 3,777,690 | 12/1973 | Garber | 114/123 |
| 4,512,277 | 4/1985 | Williams | 114/364 |
| 4,522,420 | 6/1985 | Hannappel | 440/11 |

FOREIGN PATENT DOCUMENTS

| | | | |
|---|---|---|---|
| 743359 | 9/1966 | Canada | 114/123 |
| 901 | 8/1818 | France | 114/123 |
| 315906 | 3/1934 | Italy | 114/123 |
| 63287 | 4/1984 | Japan | 114/61 |

*Primary Examiner*—Sherman D. Basinger
*Assistant Examiner*—Thomas J. Brahan

[57] ABSTRACT

The present invention provides a portable outrigger assembly particularly useful on a canoe. The assembly comprises a pontoon and a supporting structure consisting of first and second set of supports for the pontoon. The first set of supports includes adjustable clamping assemblies for clamping to both sides of the canoe with the first set of supports extending generally horizontally outwardly from one side only of the canoe. The second set of supports extend downwardly from the first set of supports to the pontoon with the entire assembly being both adjustable in setting for various different sizes of canoes and also being readily collapsed without requiring the use of tools and without affecting transportability of the canoe.

1 Claim, 4 Drawing Sheets

FIG. 2.
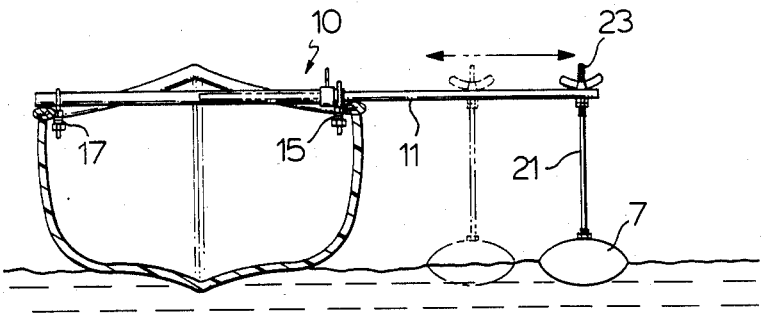
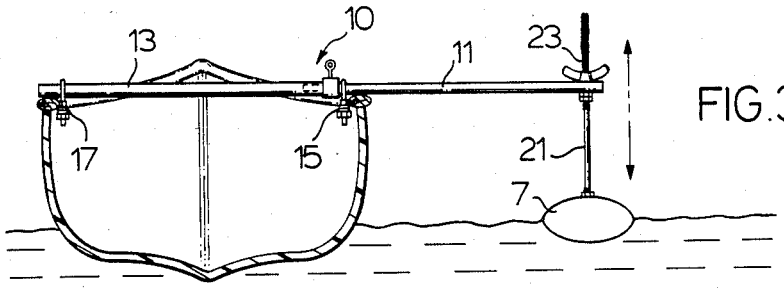
FIG. 3.
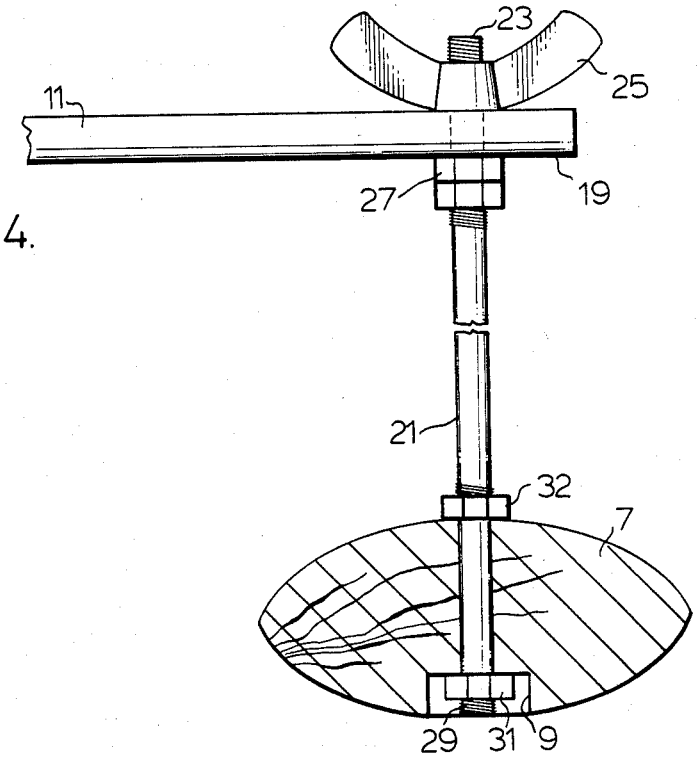
FIG. 4.

PORTABLE OUTRIGGER

This is a continuation of application Ser. No. 840,926, filed Mar. 18, 1986, now abandoned.

FIELD OF THE INVENTION

The present invention relates to a portable knock down outrigger assembly for use in stabilizing small boats and in particular canoes.

BACKGROUND OF THE INVENTION

As anyone who has spent time in small water craft, and in particular canoes, will appreciate, these craft tend to be very unstable. This prevents serious safety hazards to the point of being life threatening should the craft capsize. Therefore, there is a need for some type of stabilizing means to be provided on canoes and other similarly tippy small water craft.

A number of prior art devices have been developed to overcome the problems described above. However, typically these prior art devices are relatively complicated and costly and are not easily removed for ease of transportation by car or pick-up truck.

U.S. Pat. No. 1,132,924 issued Mar. 23rd, 1915 to Gepack and U.S. Pat. No. 1,369,670 issued Feb. 22nd, 1921 to Kauffman, as well as U.S. Pat. No. 3,537,417 issued Nov. 3rd, 1970 to Beckner all describe stabilizing devices for use on small water craft. However, the devices in each of these patents are relatively cumbersome and require outward extensions to both sides of the craft adding to both the complexity and the cost of these devices and also making the craft awkward and dangerous to dock. Furthermore, the devices in each of these patents include a relatively permanent mounting which would not make them easily transportable.

U.S. Pat. No. 3,763,813 issued Oct. 9th, 1973 to Holtz shows a unique outrigger concept using an inflatable canoe as well as an inflatable outrigger member each of which is again, provided with a permanent mounting arrangement for receiving a pair of supporting poles frictionally engaged between the canoe and the outrigger. The problem with this particular arrangement is that it is again extremely specific and not capable for use on other types of small boats other than that shown in the patent. Furthermore it provides little, if any, ballast for preventing tipping to the opposite side of the inflatable outrigger.

U.S. Pat. No. 4,512,277 issued as recently as Apr. 23rd, 1985 shows a new and improved design in clamp-on pontoons for use on a canoe. The pontoon arrangement in this patent is relatively portable however again this patent does require the use of two pontoons one to either side of the canoe each of which attaches only to that side of the canoe from which it extends requiring the other pontoon for stabilizing the load on the side walls of the canoe and preventing proper docking of the canoe.

SUMMARY OF THE PRESENT INVENTION

The present invention provides an outrigger assembly which is portable in nature and which due to its mounting assembly requires only a single pontoon to one side of a small water craft to provide an extremely effective stabilizing of the craft. More particularly, the portable outrigger assembly of the present invention comprises a pontoon and a supporting structure for the pontoon. The supporting structure itself consists of adjustable length first support means including clamping means adjustably fitted on the first support means for clamping to both sides of the craft to secure the first support means extending generally horizontally outwardly from one side of the craft only, and second support means extending from the first support means downwardly to the pontoon when the assembly is mounted to the craft.

Preferably the pontoon and the second support means are removable from the first support means which is itself collapsible allowing easy transporting of the craft.

BRIEF DESCRIPTION OF THE DRAWINGS

The above as well as other advantages and features of the present invention will be described in greater detail according to the preferred embodiments of the present invention in which:

FIGS. 2 and 3 are sectional views looking along the length of the canoe showing various different adjustments for the outrigger assembly of FIG. 1.

FIG. 4 is an enlarged sectional view showing the mounting of the pontoon to the support structure of FIGS. 1 through 3.

DETAILED DESCRIPTION ACCORDING TO THE PREFERRED EMBODIMENTS OF THE PRESENT INVENTION

Figure 1:
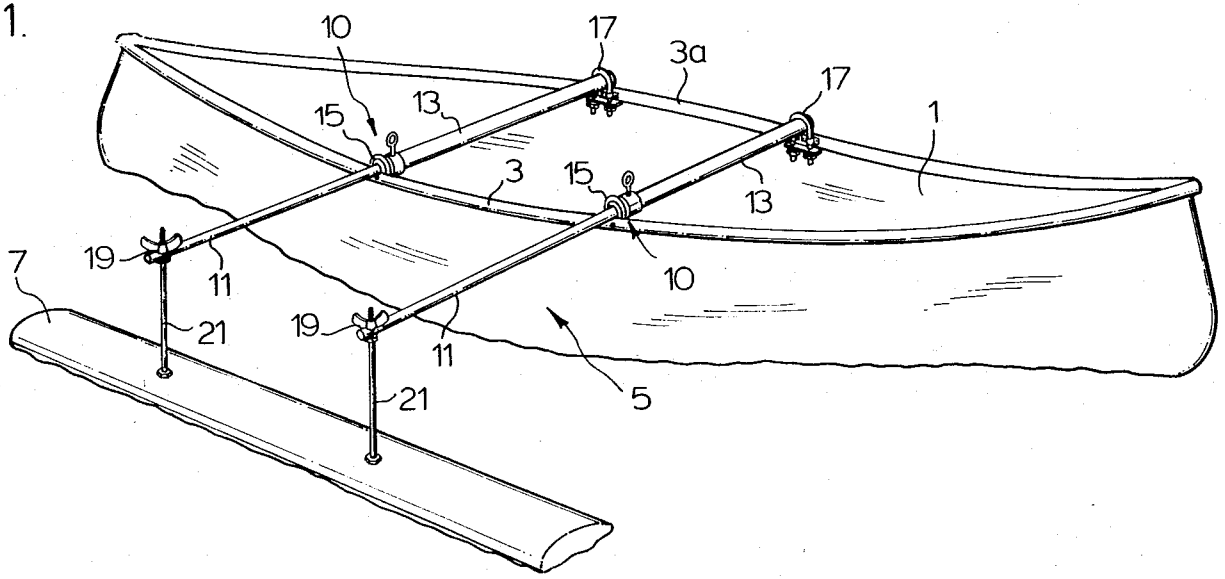
FIG. 1 is a perspective view looking down on an outrigger assembly according to a preferred embodiment of the present invention and secure to a canoe.

FIG. 1 shows a canoe 1 having side walls including gunnels 3 & **3*a* to which is mounted a portable outrigger assembly generally indicated at 5. The outrigger assembly comprises a water buoyant pontoon 7 and a supporting structure for the pontoon comprising a first set of tubular support rods 10 which extend horizontally from the canoe and a second set of tubular support rods 21 at generally right angles to support rods 10 and extending downwardly to pontoon 7**.

The important feature of the present invention relates to the mounting of the outrigger assembly to the canoe. As clearly seen in FIGS. 1 through 3 support rods 10 extend completely across the canoe and are secured to both sides of the cane by a pair of clamp assemblies 15 and 17. These clamp assemblies are slidably mounted on support rods 10 for adjusting to various different widths of canoes, which makes the outrigger assembly adaptable for use on many different shapes and sizes of small water craft, though it is particularly intended for canoes. Once the clamp assemblies, which comprise readily available hardware components, are adjusted to the proper width settings they are simply secured to either the outside or the inside of the gunnels as seen in the drawings. When on the inside of the gunnels, the clamping assemblies will fall into the boat rather than the water should they come loose or be inadvertently knocked off the gunnels.

The provision of clamps to both sides of the canoe with the support rod extending across the complete width of the canoe makes for a very stable mounting and relieves the load at each of the side walls on the canoe. This is to be contrasted to a mounting arrangement such as that found in U.S. Pat. No. 4,512,277 referred to above where the load and torque factors on the individual side walls necessitate the use of a pontoon to either side of the canoe. However, in contrast to the prior art the present invention does not require pontoons to either side of the canoe but rather requires only a single pontoon extending to one side of the canoe. The pontoon itself acts as a guide to keep the canoe running in a straight line when paddling from one side only. However because the pontoon is spaced away from the canoe, it is not in the way and readily enables paddling from both sides equally as well.

A further preferred features of the present invention is found in the adjustable positioning of the pontoon relative to the canoe. More particularly, the pontoon is adjustable in both its outward spacing and its height setting according to the particular canoe or other small water craft to which the pontoon is mounted. Typically a smaller more tippy craft requires increased stabilizing in which case the pontoon is set at a substantial outward spacing from the boat and will be brought inwardly for more stable craft. Additionally the taller the craft the lower the pontoon must be set.

FIG. 2 shows adjustment of the outward spacing of the pontoon relative to the canoe. This is accomplished through tubular support rods 10 which have a telescopic construction, comprising rod portions 11 and 13, telescopically coupled with one another as seen in FIGS. 1 through 3. The telescopic action of the two support rods allows them to be adjusted to different lengths according to the outward spacing required for the pontoon. Note that the set screws for the telescopic rods like the clamps are located to the inside of and will fall into the canoe should they become inadvertently dislodged.

FIGS. 2 and 3 show two different height settings for the second support rods 21 which like the first support rods are axially adjustable. More particularly each of the rods 21 is fitted through a drilled hole at the outer end 19 of the first support rods and is adjustably secured in position by a wing nut 25 and opposing lock nut 27 on the threaded end 23 of rod 21 to either side of rod 19.

As will be clear from FIG. 4 the height setting for rod 21 is easily adjusted by threading wind nuts 25 and nuts 27 up and down the support rod. The use of the upper wind nut readily enables the threading action since this nut can be quickly and easily manually adjusted relieving pressure on the lower nut and allowing it in turn to be manually adjusted along the rod to the proper height setting where the wing nut is then tightened downwardly into position to effectively lock the height setting. This as well as the disassembling of the pontoon and second support rods, is accomplished without requiring any tools whatsoever.

FIG. 4 also shows the securing of support rod 21 to pontoon 7. Here it will be seen that support rod 21 fits directly through the pontoon and extends at its lower threaded end 29 into a recessed region 9 at the base of the pontoon. A nut 32 traps the pontoon against climbing upwardly along the rod with a nut 31 then being threaded into position to firmly secure the pontoon. This arrangement, consistent with the remainder of the supporting structure, is made from relatively simple and readily available parts adding to the simple yet effective construction of the outrigger assembly.

The pontoon member itself may take a number of different constructions. For example, as shown in FIG. 4, pontoon 7 has a wooden construction with the wood material being one which is relatively resistant to deterioration and water logging. Here it is to be noted that when the canoe is not in use the pontoon extending to the one side of the canoe can easily be beached out of the water as a further guard against water logging and acting as an anchoring device for the beached canoe.

The wooden construction gives the pontoon substantial weight which has the advantage of adding to the ballast provided by the outrigger assembly. This added ballast is another factor which allows the use of only a single rather than a double pontoon arrangement for properly stabilizing the canoe by substantially reducing tipping of the canoe to the side opposite the outrigger assembly.

Figure 5:
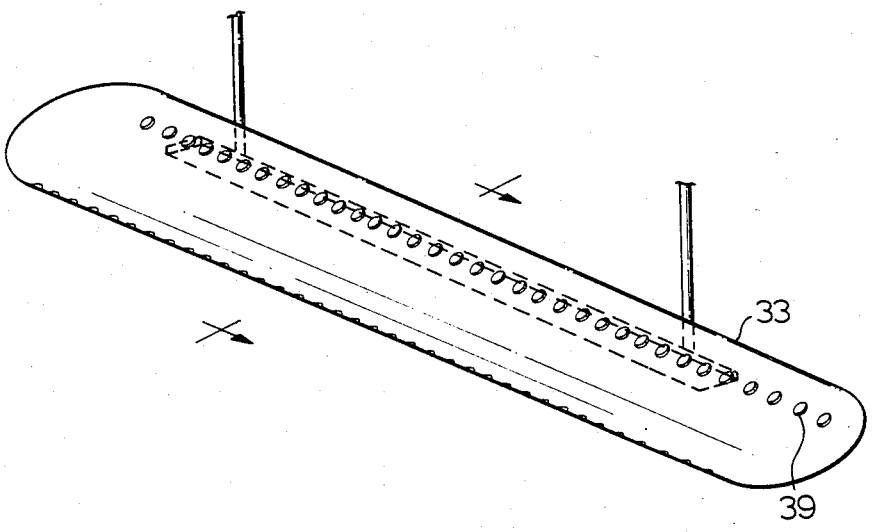
FIG. 5 is a bottom perspective view of a variant of a pontoon according to a further preferred embodiment of the present invention.
Figure 6:
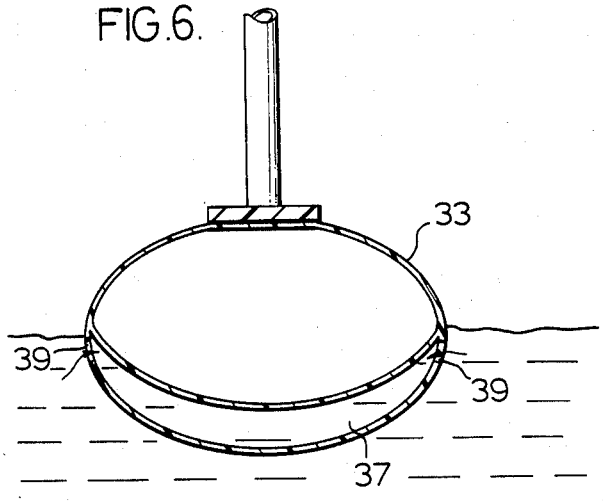
FIG. 6 is a sectional view through the pontoon of FIG. 5.

FIGS. 5 and 6 show a further embodiment pontoon which has a foam, plastic or noncorroding metal construction and is generally hollow for flotation as shown in FIG. 6 but which is extremely light in weight lending to the portability of the device when out of the water. However, in order to provide an effective ballast while in use pontoon 33 is further provided with a ballast chamber 37 which is both self filling and self draining through a series of holes 39 at the sides of the pontoon. Therefore, when the pontoon is required for use the holes are submerged and the ballast chamber begins to fill, adding substantially to the weight of the pontoon as a guard against the boat tipping or capsizing to the opposite side from the outrigger assembly. When the pontoon is removed and placed on its side ready for transportation the ballast chamber will automatically drain through the holes in the sides of the pontoon.

Figure 7:
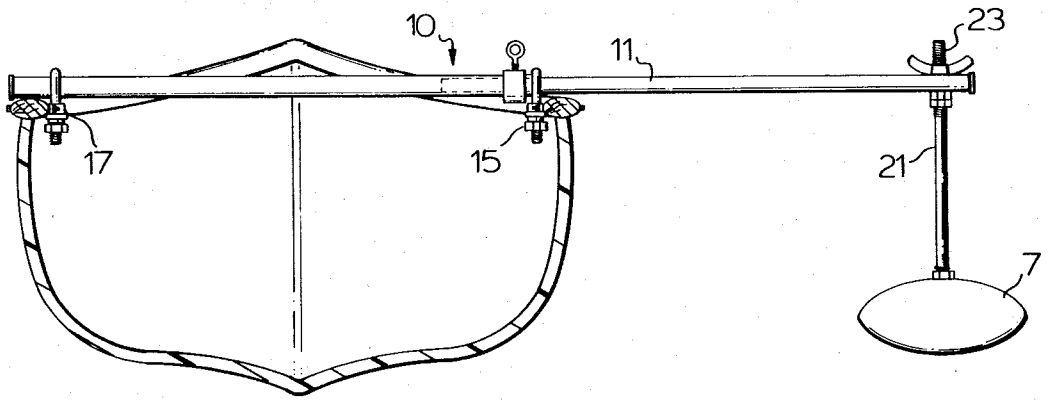
FIG. 7 is a sectional view from one end of the canoe of FIG. 1 with the outrigger assembly in a fully operative position.
Figure 8:
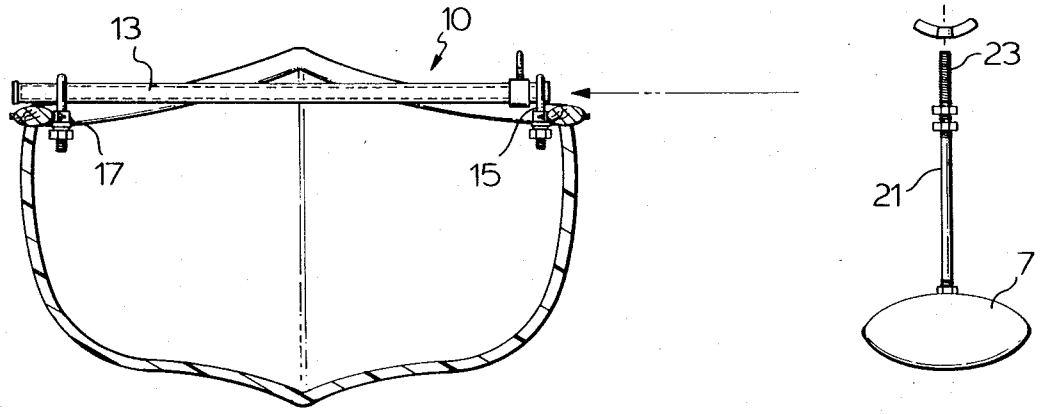
FIG. 8 is a view from the same position as FIG. 7 but showing the outrigger assembly knocked down and disassembled for transportability of the canoe.

FIGS. 7 and 8 show very clearly how the outrigger assembly when in its operative position provides very effective stabilizing for the canoe yet does not affect transportability of the canoe when the outrigger assembly is broken down and collapsed. More particularly in FIG. 8 it will be seen that both the second set of support rods 21 and the pontoon itself are quickly and easily disengaged from the first set of support rods by simply releasing wing nut 25. The first set of support rods can then be collapsed to the width of the canoe by simply releasing the set screws on the first set of support rods and telescoping them inwardly to the FIG. 8 position. Again it is to be noted that all of this is accomplished without requiring any tools whatsoever and without having to remove the first set of support rods from their clamped positions on the canoe.

Although various preferred embodiments of the invention have been described herein detail, it will be appreciated by those skilled in the art that variations may be made thereto without departing from the spirit of the invention or the scope of the appended claims.

The embodiments of the invention in which an exclusive property or privilege is claimed are defined as follows:

1. In combination, a canoe with a portable outrigger assembly, said assembly comprising a pair of fixed length mounting sleeves both having clamps at each end thereof attached to the inside of opposing gunnels generally free of overhang on said canoe, a pair of horizontal support rods telescopically fitted in said fixed length mounting sleeves, a pair of vertical support rods secured outwardly along said horizontal support rods and extending downwardly to a pontoon supported at longitudinally spaced apart locations by said vertical support rods, said vertical support rods being threadably adjustable relative to said horizontal support rods for height setting of said pontoon and said vertical support rods further being removable from said horizontal support rods with said horizontal support rods and said mounting sleeves being of substantial equal length whereby said horizontal support rods are fully slideable into said mounting sleeves for transporting said canoe without removing said mounting sleeves and horizontal support rods therefrom.

* * * * *